US010526177B2

(12) United States Patent
Duray et al.

(10) Patent No.: US 10,526,177 B2
(45) Date of Patent: Jan. 7, 2020

(54) SPEED CONTROL SYSTEM FOR CRANE AND WINCH APPLICATIONS

(71) Applicant: Eaton Intelligent Power Limited, Dublin (IE)

(72) Inventors: Vincent Joseph Duray, Edina, MN (US); Jerry Carl Weber, St. Louis, MO (US)

(73) Assignee: Eaton Intelligent Power Limited, Dublin (IE)

( * ) Notice: Subject to any disclaimer, the term of this patent is extended or adjusted under 35 U.S.C. 154(b) by 563 days.

(21) Appl. No.: 15/300,187

(22) PCT Filed: Mar. 27, 2015

(86) PCT No.: PCT/US2015/022942
§ 371 (c)(1),
(2) Date: Sep. 28, 2016

(87) PCT Pub. No.: WO2015/148900
PCT Pub. Date: Oct. 1, 2015

(65) Prior Publication Data

US 2017/0174481 A1 Jun. 22, 2017

Related U.S. Application Data

(60) Provisional application No. 61/971,902, filed on Mar. 28, 2014, provisional application No. 61/977,432, filed on Apr. 9, 2014.

(51) Int. Cl.
*B66D 1/44* (2006.01)
*B66D 1/02* (2006.01)
(Continued)

(52) U.S. Cl.
CPC ..... *B66D 1/44* (2013.01); *B66D 1/02* (2013.01); *B66D 1/08* (2013.01); *B66D 1/40* (2013.01)

(58) Field of Classification Search
CPC ... B66D 1/02; B66D 1/08; B66D 1/40; B66D 1/44
(Continued)

(56) References Cited

U.S. PATENT DOCUMENTS 4,434,616 A * 3/1984 Christopher ..... F16H 61/433 60/445
4,474,104 A * 10/1984 Creffield ..... F04B 49/06 417/18
(Continued)

FOREIGN PATENT DOCUMENTS

EP 2 341 191 B1 8/2013

OTHER PUBLICATIONS

ASME ("Graphic Symbols for Fluid Power Systems", published by ASME in 1967).*
(Continued)

*Primary Examiner* — Nathaniel E Wiehe
*Assistant Examiner* — Richard C Drake
(74) *Attorney, Agent, or Firm* — Merchant & Gould P.C.

(57) ABSTRACT

The present disclosure relates to a hydraulic system including a variable displacement hydraulic motor for lifting and lowering a load. The hydraulic motor has a high operating speed and a low operating speed. The system also includes an actuator for controlling whether the hydraulic motor is operating at the high or low speed, and a pressure sensor for sensing when a system pressure corresponding to the hydraulic motor exceeds a threshold pressure value. The system further includes a speed control system that controls the actuator such that the hydraulic motor is prevented from operating at the first operating speed when the system pressure exceeds the threshold pressure value.

21 Claims, 3 Drawing Sheets

(51) Int. Cl.
*B66D 1/40* (2006.01)
*B66D 1/08* (2006.01)

(58) Field of Classification Search
USPC ..... 60/450, 451, 490
See application file for complete search history.

(56) References Cited

U.S. PATENT DOCUMENTS

| | | | | |
|---|---|---|---|---|
| 4,727,718 | A * | 3/1988 | Koopmans | B66D 1/44 60/468 |
| 5,065,577 | A * | 11/1991 | Markunas | F03C 1/0686 60/450 |
| 5,634,335 | A * | 6/1997 | Schniederjan | F16H 39/02 60/450 |
| 6,371,447 | B1 * | 4/2002 | Imanishi | B66D 1/44 254/361 |
| 6,648,303 | B1 * | 11/2003 | Nishimoto | B66D 1/08 254/361 |
| 7,192,010 | B2 * | 3/2007 | Roodenburg | A63G 7/00 104/55 |
| 8,136,271 | B2 | 3/2012 | Sakai et al. | |
| 8,869,522 | B2 * | 10/2014 | Bohrer | A01D 75/187 56/10.2 J |
| 2005/0143219 | A1 * | 6/2005 | Shimomura | B66D 1/08 477/71 |
| 2013/0239558 | A1 * | 9/2013 | Shirao | B60W 10/06 60/327 |

OTHER PUBLICATIONS

International Search Report and Written Opinion of the International Searching Authority for corresponding International Patent Application No. PCT/US2015/022942 dated Jun. 29, 2015, 13 pgs.

* cited by examiner

SPEED CONTROL SYSTEM FOR CRANE AND WINCH APPLICATIONS

CROSS-REFERENCE TO RELATED APPLICATION(S)

This application is a National Stage Application of PCT/US2015/022942, filed on Mar. 27, 2015, which claims benefit of U.S. Patent Application Ser. No. 61/971,902 filed on Mar. 28, 2014, and U.S. Patent Application Ser. No. 61/977,432 filed on Apr. 9, 2014, the disclosures of which are incorporated herein by reference in their entireties. To the extent appropriate, a claim of priority is made to each of the above disclosed applications.

TECHNICAL FIELD

The present disclosure relates generally to hydraulic control systems. More particularly, the present disclosure relates to control systems for controlling the speed of a hydraulic motor.

BACKGROUND

Crane and winch applications often use hydraulic motors that have high and low operating speeds. High speed is used to move the winch or crane rapidly in an unloaded condition, and low speed is used when the crane or winch is loaded. In this type of system, a problem can exist when the winch or crane operator chooses to operate the hydraulic motor at a high speed when lowering a heavy load. The heavy load coupled with a high speed of travel in a downward direction can overcome the hydraulic motors torque capacity to control the load. This can cause motor failure and dropping of the load. Also, to a lesser degree, if the operator chooses to raise a heavy load in high speed, the motor may not have the torque necessary to raise it.

SUMMARY

One aspect of the present disclosure relates to a speed control system for controlling the speed of a hydraulic motor. The speed control system is configured to prevent the hydraulic motor from operating at a speed where the torque capacity of the hydraulic motor is less than the load on the hydraulic motor. In certain examples, the load on the hydraulic motor is determined based on a system pressure corresponding to the hydraulic motor. In certain examples, the speed control system and motor are used in combination with a system for lifting and lowering loads such as a crane or winch system.

Another aspect of the present disclosure relates to a speed control system for a hydraulic motor that forces the hydraulic motor to be operated at a low speed when a system pressure corresponding to the hydraulic motor exceeds a threshold pressure value. In certain examples, a pressure relief valve is used to sense the system pressure. In certain examples, the motor is controlled by a two-speed control valve that allows the hydraulic motor to be operated in either a low-speed mode or a high-speed mode. In certain examples, the volume of fluid displaced by the hydraulic motor for each rotation of the motor shaft is lower when the hydraulic motor is operated in the high-speed mode as compared to when the hydraulic motor is operating in the low-speed mode. In certain examples, hydraulic motor has a higher torque rating when operating in the low-speed mode as compared to when the hydraulic motor is operating in the high-speed mode. Thus, the high-speed mode can be referred to as a low-torque mode and the low-speed mode can be referred to as a high-torque mode. In certain examples, the hydraulic motor is a variable displacement hydraulic motor having a swash plate that is moved to control the amount of displacement provided for each rotation of the shaft of the hydraulic motor. In certain examples, the position of the swash plate is controlled by an actuator including a two-position speed control valve that causes the hydraulic motor to operate in the high-speed mode when in a first valve position and causes the hydraulic motor to operate in the low-speed mode when in a second valve position. In certain examples, the two-speed control valve can be moved between the first and second valve positions by a hydraulic control signal (e.g., a pilot signal) or by an electronic signal applied to a driver such as a solenoid.

In a further example, the present disclosure relates to a hydraulic system including a variable displacement hydraulic motor for lifting and lowering a load. The hydraulic motor has a first operating speed and a second operating speed. The first operating speed is higher than the second operating speed. The hydraulic motor has a first displacement value corresponding to the first operating speed and a second displacement value corresponding to the second operating speed. The first displacement value is less than the second displacement value. In certain examples, a displacement value is the volume of displacement corresponding to the hydraulic motor for each rotation of a shaft of the hydraulic motor. The hydraulic system also includes an actuator for controlling whether the hydraulic motor is operating at the first operating speed or at the second operating speed. The hydraulic system further includes a pressure sensor for sensing when a system pressure corresponding to the hydraulic motor exceeds a threshold pressure value. The hydraulic system further includes a speed control system that controls the actuator such that the hydraulic motor is prevented from operating at the first operating speed when the system pressure exceeds the threshold pressure value.

A variety of additional inventive aspects will be set forth in the description that follows. The inventive aspects can relate to individual features and to combinations of features. It is to be understood that both the foregoing general description and the following detailed description are exemplary and explanatory only and are not restrictive of the broad inventive concepts upon which the examples disclosed herein are based.

DETAILED DESCRIPTION

Figure 1:
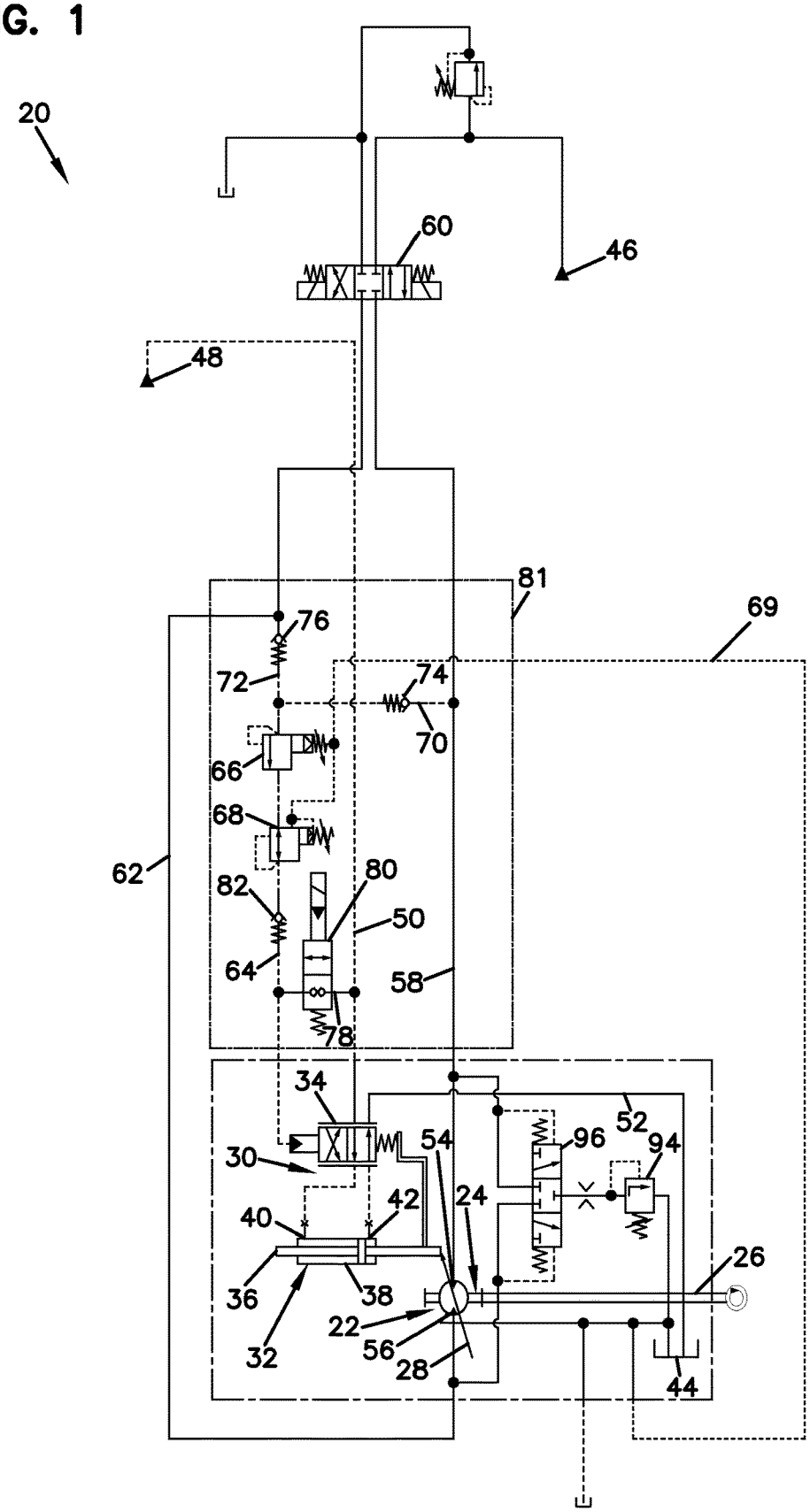
FIG. 1 is a schematic view showing a hydraulic motor speed control system in accordance with the principles of the present disclosure.

FIG. 1 illustrates a hydraulic system 20 in accordance with the principles of the present disclosure. The hydraulic system 20 includes a variable displacement hydraulic motor 22 having a drive shaft 24 that can be coupled to a device 26. In certain examples, the device 26 can be a device suitable for lifting and lowering a load such as a winch device, a crane-mounted winch device, or other type of device. In certain examples, the hydraulic system 20 includes a speed control system that automatically forces the hydraulic motor 22 to operate in a lower speed, higher torque mode when the hydraulic motor 22 is under higher loads (e.g., when the device 26 is lifting or lowering a load above a predetermined weight). In this way, the speed control system controls operation of the motor speed so as to ensure that a lifted load does not exceed the torque capacity of the hydraulic motor 22. In certain examples, the hydraulic motor 22 can be operated as a two-speed motor having a high-speed mode and a low-speed mode. In such an example, the control system forces the hydraulic motor 22 to operate in the low-speed mode when a load above a predetermined level is detected. In certain examples, the load level can be detected by sensing a hydraulic pressure in a system line corresponding to the hydraulic motor 22. While the examples depicted herein include control systems for operating the hydraulic motor 22 as a two-speed motor, it will be appreciated that the various aspects of the present application are also applicable to systems that can operate the hydraulic motor in more than two speeds or even in an infinite number of speeds. In such examples, the speed control system may automatically set the speed of the variable displacement hydraulic motor to a speed at which the motor has a torque rating equal to or greater than the sensed load.

In one example, the hydraulic motor 22 is an axial piston motor that includes a swash plate 28 that can be moved to adjust the rate of displacement of the hydraulic motor 22. In certain examples, the swash plate 28 can be positioned at a first orientation that corresponds to a high-speed mode of the hydraulic motor 22 and a second orientation that corresponds to a low-speed mode of the hydraulic motor 22. In the high-speed mode, the hydraulic motor 22 operates at a relatively high speed, has a relatively small displacement value, and has a relatively low torque rating. As used herein, the phrase "displacement value" represents the volume of hydraulic fluid displaced through the hydraulic motor 22 during one rotation of the drive shaft 24. When the hydraulic motor 22 is operating in the low-speed mode, the drive shaft 24 rotates at a relatively slow speed, the hydraulic motor 22 has a relatively high displacement value and the hydraulic motor 22 has a relatively high torque value. It will be appreciated that the hydraulic motor 22 has a slower shaft speed, higher displacement value and higher torque rating when operating in the low-speed mode as compared to the high-speed mode. In one example, the hydraulic motor 22 operates at full/maximum displacement when in the low-speed mode. In one example, when the hydraulic motor 22 is operating in the high-speed mode, the swash plate 28 is positioned such that the displacement of the hydraulic motor 22 is less than or equal to about one-third of the maximum displacement value.

The position of the swash plate 28 is controlled by an actuator 30. The actuator 30 includes a hydraulic drive 32 mechanically coupled to the swash plate 28 and a two-speed control valve 34. The two-speed control valve 34 interfaces with the hydraulic drive 32 so as to control the position of the swash plate 28. In the depicted example, the hydraulic device 32 is depicted as a hydraulic cylinder having a piston 36 that reciprocates within a cylinder 38. The cylinder 38 includes a first port 40 and a second port 42. The two-speed control valve 34 selectively provides charge pressure to the first and second ports 40, 42 to control the position of the piston 36 and thus the position of the swash plate 28. As shown at FIG. 1, the two-speed control valve 34 is depicted in a first position (a left position as shown at FIG. 1) in which charge pressure is provided to the first port 40 thereby causing the hydraulic drive 32 to move the swash plate 28 to the first orientation corresponding to the high-speed mode of the hydraulic motor 22. With the two-speed control valve 34 in the first position, the second port 42 is coupled to tank 44. To operate the hydraulic motor 22 in the low-speed mode, the two-speed control valve 34 is moved to a second position (e.g., a right position) in which the first port 40 is coupled to tank and the second port 42 is coupled to charge pressure. This causes the piston 36 to slide to the left thereby causing the swash plate 28 to move to the second orientation corresponding to the low-speed mode of the hydraulic motor 22. In the depicted embodiment, the two-speed control valve 34 is spring biased toward the first position which corresponds to the high-speed mode of the hydraulic motor 22. Thus, absent the detection of a load in excess of the predetermined load threshold, the two-speed control valve 34 will default to the first position thereby setting the hydraulic motor 22 in the high-speed mode.

Referring still to FIG. 1, the hydraulic system 20 includes a system pump 46 and a charge pressure source 48. A charge pressure line 50 extends from the charge pressure source 48 to the two-speed control valve 34. A return line 52 extends from the two-speed control valve 34 to tank 44. The hydraulic motor 22 includes a first port 54 and a second port 56. A first system line 58 extends from the first port 54 to a three-position directional control valve 60. A second system line 60 extends from the second port 56 to the three-position directional control valve 60. The three-position directional control valve 60 controls the direction of flow through the first and second system lines 58, 62. Thus, by altering the position of the three-position directional control valve 60, the first and second ports 54, 56 can be alternated between input ports and output ports. For example, to drive the hydraulic motor 22 in a first direction, the three-position directional control valve 60 is moved to a first position (e.g., a left position) in which the system pump 46 is placed in fluid communication with the first port 54 and the second port 56 is placed in fluid communication with tank thereby causing the hydraulic motor 22 to be driven in a first rotational direction. In contrast, the three-position directional control valve 60 is moved to a second position (e.g., a right position), the second port 56 is placed in fluid communication with the system pump 46 and the first port 54 is placed in fluid communication with tank thereby causing the hydraulic motor 22 to be driven in a second rotational direction. When the three-position directional control valve 60 is in the neutral position (as shown at FIG. 1), fluid communication is broken between the system pump 46 and the first and second ports 54, 56. The system 20 can also include a purge valve 94 that is placed in fluid communication with the high pressure side of the motor 22 by a three-position valve 96.

The hydraulic system 20 also includes a speed-control pilot line 64 for applying pilot pressure to the two-speed control valve 34 to move the two-speed control valve 34 from the first position (e.g., the left position) to the second position (i.e., the right position). As indicated above, moving the two-speed control valve 34 to the second/right position causes the hydraulic motor 22 to be operated in the low-speed mode. As shown at FIG. 1, a pressure relief valve 66 and a pressure-reducing valve 68 are positioned along the speed control pilot line 64. It will be appreciated that the pressure relief valve 66 is one example of a pressure sensor or pressure sensing device that can be used in accordance with the principles of the present disclosure. The hydraulic system 20 also includes a first pressure sensing line 70 that extends from the first system line 58 to the speed control pilot line 64 and a second pressure sensing line 72 that extends from the second system line 62 to the speed control pilot line 64. The first pressure sensing line 70 includes a first check valve 74 that allows hydraulic fluid to flow from the first system line 58 toward the pressure relief valve 66 but prevents hydraulic fluid from flowing in the opposite direction from the pressure relief valve 66 toward the first system line 58. A second check valve 76 is positioned along the second pressure sensing line 72. The second check valve 76 allows hydraulic fluid to flow through the second pressure sensing line 72 to the relief valve 66 but prevents hydraulic fluid from flowing in an opposite direction through the second pressure sensing line 72 (i.e., flow is prevented from flowing from the pressure relief valve 66 through the second pressure sensing line 72 to the second system line 62). The configuration of the first and second pressure sensing lines 70, 72 with their corresponding first and second check valves 74, 76 ensures that the system line 58, 62 having the higher pressure is placed in fluid communication with the pressure relief valve 66. For example, when the first system line 58 has a higher pressure than the second system line 62, the first system line 58 is placed in fluid communication with the pressure relief valve 66. In contrast, when the second system line 62 has a higher pressure than the first system line 58, the second system line 62 is placed in fluid communication with the pressure relief valve 66. As used herein, the term "system pressure" refers to the pressure at the high pressure side of the hydraulic motor 22.

In certain examples, the pressure relief valve 66 is set with a pressure relief value (e.g., a pressure threshold) that corresponds with the torque rating of the hydraulic motor 22 when operating in the high-speed mode. For example, when the hydraulic motor 22 is driving the device 26 so as to lift a load, the pressure on one side of the hydraulic motor 22 increases. The system pressure at the high pressure side of the hydraulic motor 22 is thus representative of the load being lifted by the device 26. The threshold pressure of the pressure relief valve 66 can be set to a pressure that corresponds to a load value that approaches a load that is too heavy for the hydraulic motor 22 to handle when operating in the high-speed mode given the relatively low torque rating corresponding to the high-speed mode. Thus, the selected pressure threshold is related to the value of the torque rating of the hydraulic motor 22 when operating in the high-speed mode.

The hydraulic system 20 further includes an operator control line 78 that extends between the speed control pilot line 64 and the charge pressure line 50. An operator control valve 80 is positioned along the operator control line 78. The operator control valve 80 is moveable between a first position (e.g., an upper position as shown) where the operator control valve 80 closes fluid communication through the operator control lines 78 and a second position (e.g., a lower position) in which fluid communication through the operator control line 78 is opened between the charge pressure line 50 and the speed control pilot line 64. It will be appreciated that the position of the operator control valve 80 can be controlled by the operator (e.g., via a switch or other structure). For example, under low load conditions, the operator can position the operator control valve 80 in the first position such that no pilot pressure is provided to the speed control pilot lines 64 and the two-speed control valve 34 remains in the position of FIG. 1 corresponding to the high-speed operating mode of the hydraulic motor 22. By switching the operator control valve 80 to the second position, pilot pressure from the charge pressure line 50 is directed through the operator control line 78 to the speed control pilot line 64. Such pilot pressure causes the two-speed control valve 34 to move to the second position (i.e., the right position) which corresponds to the low-speed mode of the hydraulic motor 22. A one-way check valve 82 is provided along the speed control pilot line 64 for preventing fluid from the charge pressure line 50 from flowing toward the pressure reducing valve 68 when the operator control valve 80 is in the open position.

In use of the hydraulic system 20, when the system pressure in either of the first or second system lines 58, 62 exceeds the threshold pressure value set by the pressure relief valve 66, the pressure relief valve 66 opens thereby directing system pressure through the speed control pilot line 64 to the pressure reducing valve 68. The pressure reducing valve 68 reduces the system pressure to a pilot pressure that is compatible with the pilot arrangement of the two-speed control valve 34. The pressure reducing valve 68 includes a drain line 69 coupled to tank. The pilot pressure provided to the speed control pilot lines 64 by the pressure reducing valve 68 is applied to the two-speed control valve 34 thereby causing the two-speed control valve 34 to move from the first position (i.e., left position as shown) to the second position (i.e., the right position. As indicated previously, when the two-speed control valve 34 is moved to the second position, charge pressure from the charge pressure line 50 causes the smash plate to be moved such that the hydraulic motor 22 operates in the low-speed mode. As shown at FIG. 1, the speed control pilot line 64 bypasses (i.e., does not pass through) the operator control valve 80. Therefore, when the control pilot line 64 is pressurized by pressure from the pressure reducing valve 68, such pressure will cause the hydraulic motor 22 to be operated in the low-speed mode even when the operator control valve 80 is closed. When pilot pressure is provided to the speed control pilot line 64 by the pressure reducing valve 68 while the operator control valve 80 is in the open position, the hydraulic motor 22 operates in the low-speed mode and continues to operate in the low-speed mode even if the operator switches the operator control valve 80 to the closed position.

During lifting of a load, hydraulic pressure from the system pump 46 drives the hydraulic motor 22 causing the load to be lifted. If the weight of the load causes the system pressure at the high pressure side of the hydraulic motor 22 to exceed the pressure threshold set by the pressure relief valve 66, pilot pressure is immediately provided to the speed control pilot line 64 through the valves 66, 68 thereby causing the hydraulic motor 22 to immediately switch to the low-pressure mode if the hydraulic motor 22 had been previously operating in the high-pressure mode or to maintain the hydraulic motor 22 in the low-pressure mode if the hydraulic motor 22 had already been operating in the low-pressure mode. To lower the load, the hydraulic motor 22 reverses direction while the high pressure side remains on the same side of the hydraulic motor 22. During lowering, the motor restricts flow to counteract the weight of the load and the load determines the pressure on the high pressure side of the motor. In other words, during lowering, the motor controls travel by regulating flow to slow and control an otherwise free fall condition. In this way, the hydraulic motor 22 provides a braking action/function. During lowering, as long as the pressure generated by the load at the high pressure side of the hydraulic motor 22 remains above the threshold pressure set by the pressure relief valve 66, the hydraulic motor 22 will be forced to remain in the low-speed mode regardless of the position of the operator control valve 80.

It will be appreciated that the various aspects of the present disclosure are applicable to both closed loop and open loop systems. Also, in certain examples, various components (e.g., valves 66, 68, 74, 76, 80) of the system can be incorporated into a bolt-on valve block 81.

Figure 2:
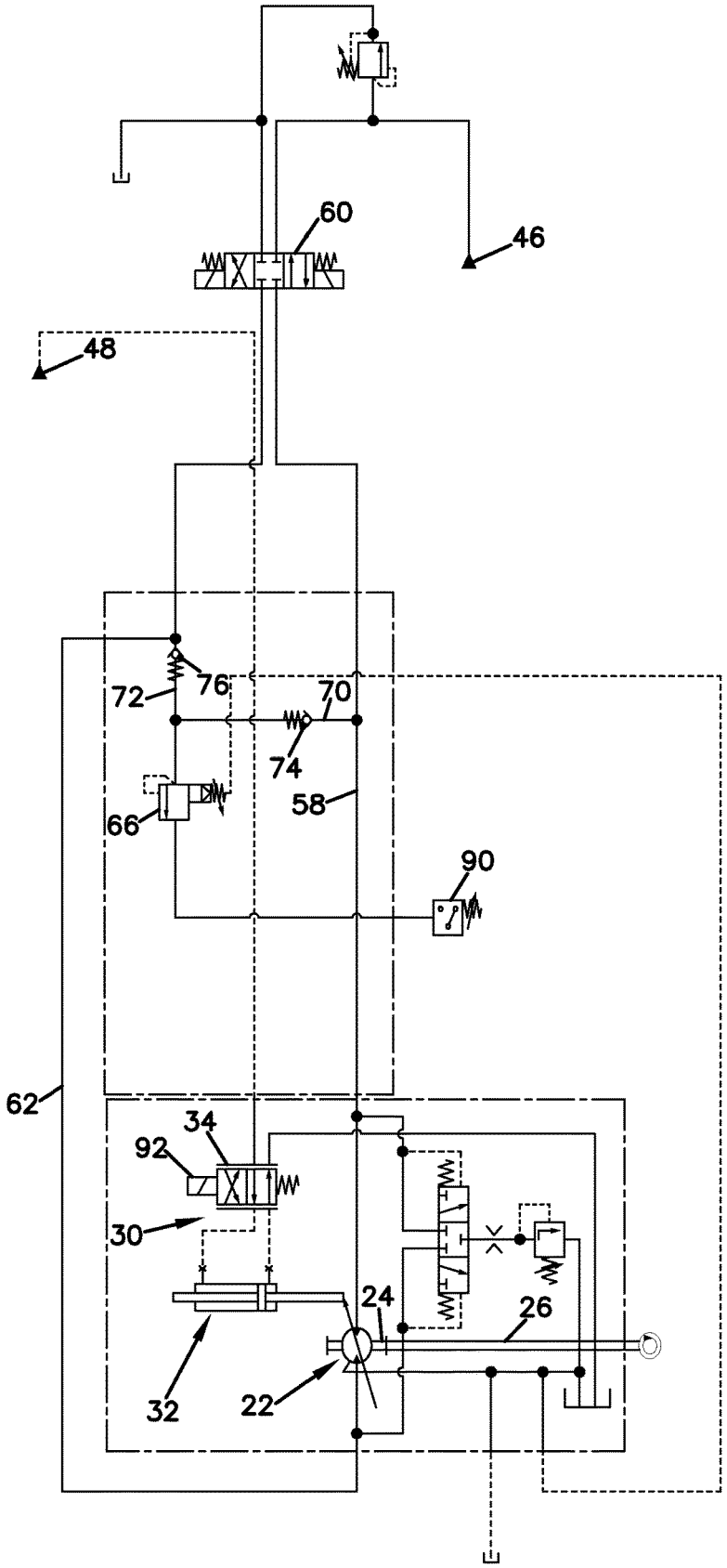
FIG. 2 is a schematic view illustrating another hydraulic motor speed control system in accordance with the principles of the present disclosure.

While FIG. 1 illustrates a system that uses hydraulic pilot signals to control the actuator 30, it will be appreciated that the actuator 30 can also be controlled by electrical signals. For example, FIG. 2 shows an embodiment having the same basic design as the hydraulic system 20 except the speed control pilot line 64 has been replaced with an electric switch 90. The electric switch 90 is actuated when it senses pressure from the pressure relief valve 66. Actuation of the electronic switch 90 can cause actuation of an electric solenoid 92 that moves the two-speed control valve 34 to the second position (i.e., the right position) such that the actuator 30 causes the hydraulic motor 22 to operate in the low-speed mode. Similar to the previously described embodiment, the signal from the switch 90 overrides signals that may be generated by an operator control switch. In this way, as long as the system pressure exceeds the threshold value set by the pressure relief valve 66, the hydraulic motor 22 is prevented/prohibited from operating in the high-speed mode.

Figure 3:
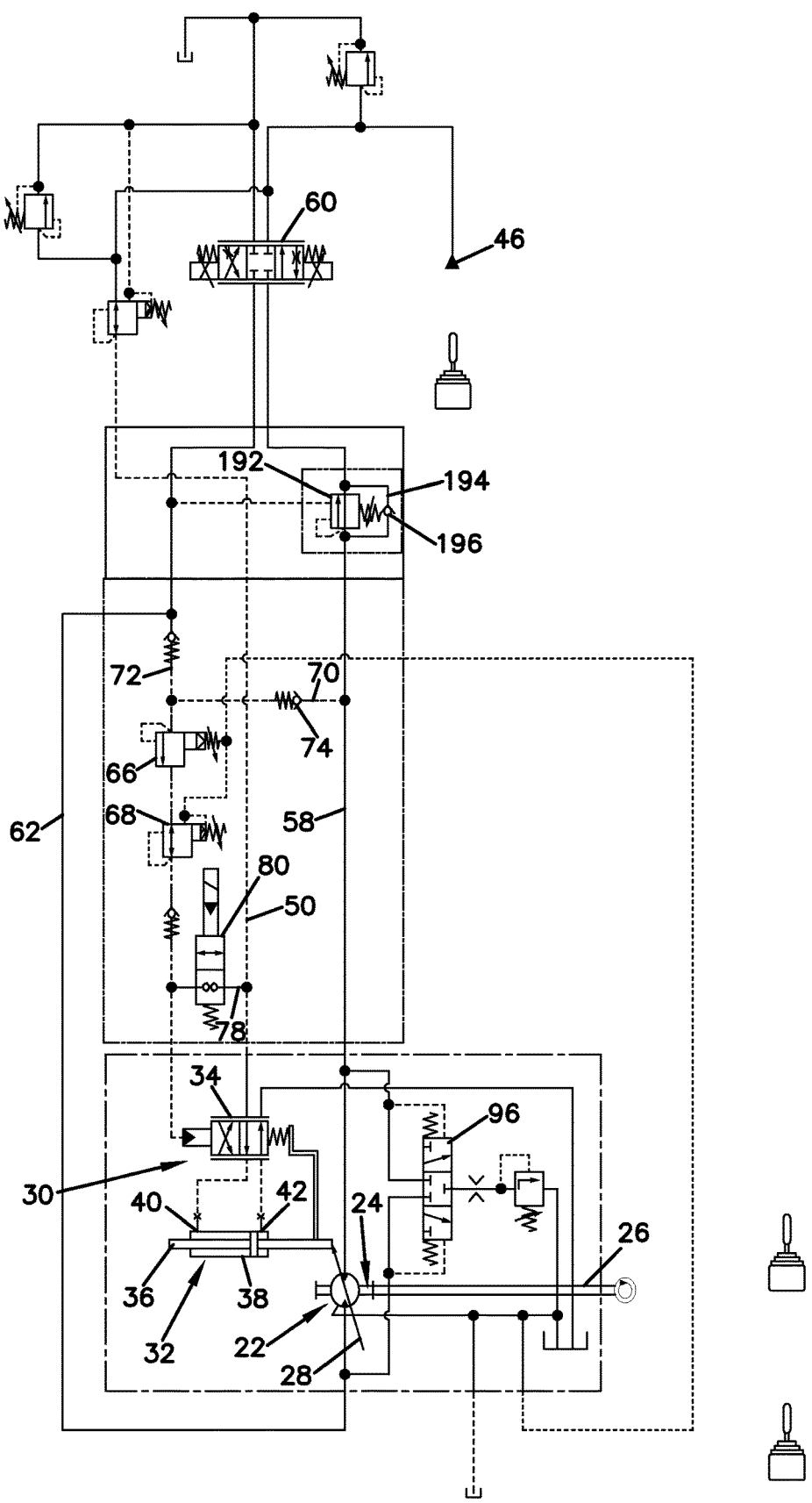
FIG. 3 is a schematic view illustrating a further hydraulic motor speed control system in accordance with the principles of the present disclosure.

FIG. 3 shows another system in accordance with the principles of the present disclosure. The system of FIG. 3 has the same basic components and arrangement as the system of FIG. 1, except at least one counterbalance valve 192 has been depicted along at least one of the first or second system lines 58, 62 between the motor 22 and the directional control valve 60. As depicted, the counterbalance valve 192 is positioned along the system line 58. A bypass 194 is provided around the counterbalance valve 192. The by-pass 194 includes a one-way check valve 196 that allows hydraulic fluid to flow through the by-pass in a direction from the pump 46 to the motor and that blocks/prevents hydraulic fluid flow through the by-pass in the opposite direction (i.e., away from the motor 22). The counterbalance valve 192 is configured to provide load holding stability for ensuring that a load lifted by the device 26 (i.e., the winch) remains elevated at a desired position/height. In the depicted example, the threshold pressure reading is taken at a location between the counterbalance valve 192 and the motor 22. For example, line 70 connects to the system line 58 at a location between the counterbalance valve 192 and the motor 22. The sensor 66 monitors the system pressure on the high pressure on the motor 22 when a load is being lifted, when the load is held stationary in the air, and when the load is being lowered.

To lift a load, hydraulic fluid from the pump 46 is pumped through system line 58, past the counterbalance valve 192 via the bypass 194, and through the motor 22 to cause the load to be lifted by the device 26. When lifting a load above a pre-determined weight, the system is forced to operate in the low speed mode as described above. When pump flow to the motor 22 is stopped, the motor stops lifting the load. The weight of the raised load applies back-pressure to the system line 58 via the motor 22. The backpressure in the system line 58 is applied against the counterbalance valve 192. When it is desired to hold the load, the counterbalance valve 192 is operated to prevent flow through the counterbalance valve 192 thereby holding the load at a constant height/elevation and maintaining constant backpressure in the system line 58. When it is desired to lower the load, the counterbalance valve 192 meters or otherwise controls flow through the line 58 in a direction away from the motor 22. In this way, the counterbalance valve 192 provides for controlled lowering of the load. During lowering of a load above a pre-determined weight, the system is forced to operate in the low speed mode as described above.

What is claimed is:

1. A hydraulic system comprising:

a variable displacement hydraulic motor for lifting and lowering a load, the hydraulic motor having a first operating speed and a second operating speed, the first operating speed being higher than the second operating speed, the hydraulic motor having a first displacement value corresponding to the first operating speed and a second displacement value corresponding to the second operating speed, the first displacement value being less than the second displacement value;

an actuator for controlling whether the hydraulic motor is operating at the first operating speed or the second operating speed;

a pressure sensor for sensing when a system pressure corresponding to the hydraulic motor exceeds a threshold pressure value; and a speed control system that controls the actuator such that the hydraulic motor is prevented from operating at the first operating speed when the system pressure exceeds the threshold pressure value;

wherein the actuator includes a two-position valve and a hydraulic drive that is mechanically coupled to a swash plate of the hydraulic motor, wherein the two-position valve controls a position of the swash plate though operation of the hydraulic drive, wherein the speed control system includes a speed control pilot line for providing a pilot signal to the two-position valve, wherein the speed control pilot line extends from the pressure relief valve to the two-position valve.

2. The hydraulic system of claim 1, wherein the hydraulic motor drives a winch.

3. The hydraulic system of claim 1, wherein the hydraulic motor drives a winch of a crane.

4. The hydraulic system of claim 1, wherein the speed control system automatically causes the actuator to shift the hydraulic motor to the second operating speed when the threshold pressure value is exceeded while the hydraulic motor is set to operate in the first operating speed, and wherein the speed control system prevents the actuator from being shifted from the second operating speed to the first operating speed when the threshold pressure value is exceeded while the hydraulic motor is operating at the second operating speed.

5. The hydraulic system of claim 1, wherein the actuator includes a two-position motor control having a high-speed mode where the hydraulic motor is operated at the first operating speed and a low-speed mode where the hydraulic motor is operated at the second operating speed.

6. The hydraulic system of claim 5, wherein the second displacement value of the hydraulic motor equals a full displacement value of the hydraulic motor when the hydraulic motor is operating at the low-speed mode and the first displacement value of the hydraulic motor is less than or equal to one third of the full displacement value when the hydraulic motor is operating at the high-speed mode.

7. The hydraulic system of claim 1, wherein the actuator defaults to the first operating speed when the system pressure is less than the threshold pressure value.

8. The hydraulic system of claim 1, further comprising an operator control valve for allowing an operator to manually select between the first operating speed and the second operating speed, and wherein the speed control system overrides the operating speed selected by the operator control when the threshold pressure value is exceeded.

9. The hydraulic system of claim 1, wherein the hydraulic system is a closed loop system or an open loop system.

10. The hydraulic system of claim 1, wherein the actuator controls a position of a swash plate of the hydraulic motor.

11. The hydraulic system of claim 1, wherein the control system uses an electronic signal to control the actuator.

12. The hydraulic system of claim 1, wherein the control system uses a hydraulic signal to control the actuator.

13. The hydraulic system of claim 12, wherein the speed control system includes a speed control pilot line for providing the hydraulic signal to the actuator, wherein the hydraulic system further includes an operator control valve for allowing an operator to manually select between the first operating speed and the second operating speed, and wherein the speed control pilot line by-passes the operator control valve.

14. The hydraulic system of claim 1, wherein the pressure sensor is a pressure relief valve.

15. The hydraulic system of claim 1, wherein the actuator includes a two-position valve and a hydraulic drive that is mechanically coupled to a swash plate of the hydraulic motor, and wherein the two-position valve controls a position of the swash plate though operation of the hydraulic drive.

16. The hydraulic system of claim 1, wherein the hydraulic motor includes a first port and a second port, wherein the first and second ports can be alternatingly operated as input ports and output ports to alternate a direction of the hydraulic motor, wherein a first system line is coupled to the first port and a second system line is coupled to the second port, wherein the pressure sensor is coupled to the first system line when the first system line has a higher pressure than the second system line, and wherein the pressure sensor is coupled to the second system line when the second system line has a higher pressure than the first system line.

17. The hydraulic system of claim 16, further comprising a first pressure sensing line for coupling the first system line to the pressure sensor and a second pressure sensing line for coupling the second system line to the pressure sensor, wherein the first pressure sensing line includes a first check valve that allows flow through the first pressure sensing line in a direction toward the pressure sensor and prevents flow through the first pressure sensing line in a direction away from the pressure sensor, and wherein the second pressure sensing line includes a second check valve that allows flow through the second pressure sensing line in a direction toward the pressure sensor and prevents flow through the second pressure sensing line in a direction away from the pressure sensor.

18. The hydraulic system of claim 17, wherein the pressure sensor includes a pressure relief valve.

19. The hydraulic system of claim 18, wherein a pressure reducing valve is provided along the speed control pilot line.

20. The hydraulic system of claim 19, wherein the two-position valve is coupled to a charge pressure line that provides pressure for driving the hydraulic drive, wherein an operator control line extends between the charge pressure line and the speed control pilot line, and wherein an operator control valve is provided along the operator control line for selectively opening and closing fluid communication between the charge pressure line and the speed control pilot line.

21. The hydraulic system of claim 1, further comprising a counterbalancing valve that provides the system with load holding stability, wherein the pressure sensor senses the system pressure at a location between the counterbalancing valve and the motor.

* * * * *